US012137779B1

(12) United States Patent
Ma et al.

(10) Patent No.: US 12,137,779 B1
(45) Date of Patent: Nov. 12, 2024

(54) 3-IN-1 CONNECTOR SYSTEM FOR SHADING STRUCTURE

(71) Applicants: Mark J.S. Ma, Walnut, CA (US); Yungcheng Ma, Walnut, CA (US)

(72) Inventors: Mark J.S. Ma, Walnut, CA (US); Yungcheng Ma, Walnut, CA (US)

( * ) Notice: Subject to any disclaimer, the term of this patent is extended or adjusted under 35 U.S.C. 154(b) by 0 days.

(21) Appl. No.: 18/741,577

(22) Filed: Jun. 12, 2024

(51) Int. Cl.
*A45B 25/10* (2006.01)
*A45B 23/00* (2006.01)

(52) U.S. Cl.
CPC ..... *A45B 25/10* (2013.01); *A45B 23/00* (2013.01); *A45B 2023/0012* (2013.01)

(58) Field of Classification Search
CPC ..... A45B 25/02; A45B 25/10
USPC ..... 135/28, 29
See application file for complete search history.

(56) References Cited

U.S. PATENT DOCUMENTS 348,223 A * 8/1886 Logan ..... A45B 25/02 135/32
1,136,887 A * 4/1915 Penn ..... A45B 25/06 135/30
1,149,828 A * 8/1915 Hartzell ..... A45B 25/02 135/29
1,264,075 A * 4/1918 Hout ..... A45B 25/02 135/29
3,177,882 A * 4/1965 Militano ..... A45B 25/02 D3/10
4,368,749 A * 1/1983 Lindler ..... A45B 25/10 135/30
5,193,566 A * 3/1993 Chen ..... A45B 25/02 135/31
5,715,853 A * 2/1998 Lin ..... A45B 25/02 403/59
6,311,706 B1 11/2001 Sato
7,891,367 B2 2/2011 Ma
8,061,375 B2 11/2011 Ma
8,082,935 B2 12/2011 Ma
8,166,986 B2 5/2012 Ma
8,443,819 B2 * 5/2013 Beaulieu ..... A45B 25/18 135/32
9,078,497 B2 7/2015 Ma
10,034,524 B2 7/2018 Ma
(Continued)

FOREIGN PATENT DOCUMENTS

CN 213939930 U 8/2021

*Primary Examiner* — Noah Chandler Hawk
(74) *Attorney, Agent, or Firm* — Ying-Ting Chen

(57) ABSTRACT

A 3-in-1 connector system for a shading structure includes a base body having a central through hole for deposing a main supporting pole, a plurality of retaining members axially arranged around the central through hole, wherein one of the plurality of the retaining member has a retaining receiving cavity; a plurality of joint connectors; an extension member configured to couple with an upper supporting frame and having an extension receiving cavity for receiving and securing one of the plurality of the joint connectors with a lower supporting frame to form a first lock position and a first unlock position; wherein another one of the plurality of the joint connectors is receiving and securing inside the retaining receiving cavity; one of the plurality of the retaining member has a plurality of first elastic sheets configured to perform a second lock position and a second unlock position.

19 Claims, 9 Drawing Sheets

(56) References Cited

U.S. PATENT DOCUMENTS

| | | | |
|---|---|---|---|
| 10,292,466 | B2 | 5/2019 | Ma |
| 2020/0315306 | A1 | 10/2020 | Ma |

* cited by examiner

3-IN-1 CONNECTOR SYSTEM FOR SHADING STRUCTURE

FIELD OF THE DISCLOSURE

The present disclosure introduces a novel connector hub for a shade structure. This uniquely configured connector can cooperate with frame members of such structures, enabling rapid and secure coupling of one member to another during the setup of such structures.

BACKGROUND OF THE DISCLOSURE

Generally, large umbrellas, such as market umbrellas, generally include a frame-like structure that is used to support and distribute the weight of an upper portion of the umbrella as well as to enable the umbrella to be opened and closed as desired by the user. The frame-like structure of such umbrellas can take various forms, but often includes one more hub connected with a plurality of movable structural members. The interconnection between hubs and structural members, such as umbrella ribs, previously had been achieved in an inconvenient way that was not adapted for rapid or low-cost assembly. In general, such prior interconnections were achieved in manufacturing by assembling a hub with a large number of pins and fasteners and coupling the ribs one by one to the hub with these pins and fasteners prior to the full assembly of the hub. This process was extremely labor-intensive, costly, and could not be achieved quickly to provide suitable assembly times. This process also involved a large number of subcomponents, which could be difficult to manage in a supply chain, as well as in the assembly process itself.

Furthermore, an attempt has been made to improve large umbrella structures for user convenience. However, the design of the improved large umbrella structure does not ensure a secure lock between the ribs and the hub. This lack of a secure connection can lead to the ribs slipping from the hub, compromising the structure's stability.

All referenced patents, applications and literatures are incorporated herein by reference in their entirety. Furthermore, where a definition or use of a term in a reference, which is incorporated by reference herein, is inconsistent or contrary to the definition of that term provided herein, the definition of that term provided herein applies and the definition of that term in the reference does not apply. The disclosed embodiments may seek to satisfy one or more of the above-mentioned desires. Although the present embodiments may obviate one or more of the above-mentioned desires, it should be understood that some aspects of the embodiments might not necessarily obviate them.

BRIEF SUMMARY OF THE DISCLOSURE

In a general implementation, a 3-in-1 connector system for a shading structure may comprise a base body having a central through hole for deposing a main supporting pole and a plurality of retaining members axially arranged around the central through hole and one of the plurality of the retaining members comprises a retaining receiving cavity; a plurality of joint connectors; an extension member configured to couple with an upper supporting frame and having an extension receiving cavity for receiving and securing one of the plurality of the joint connectors with a lower supporting frame to form a first lock position and a first unlock position; wherein another one of the plurality of the joint connectors is receiving and securing inside the retaining receiving cavity; wherein the retaining member comprises a plurality of first elastic sheets configured to perform a second lock position and a second unlock position.

In another aspect combinable with the general implementation, at least one of the each of the plurality of the retaining members may comprise a pair of side receiving cavities symmetrically arranged on two sides of the retaining receiving cavity and one of the plurality of the first elastic sheets is arranged on one of the pair of the side receiving cavities and another one of the plurality of the first elastic sheets is arranged on another one of the plurality of the side receiving cavities of the retaining member.

In another aspect combinable with the general implementation, each of the plurality of the joint connectors comprises a hollow main joint body, a front portion integrally extended from the hollow main joint body, and a pair of side joint bodies symmetrically formed on two sides of the front portion, wherein each of the pair of the side joint bodies is slid to be received inside each of a pair of side receiving cavities.

In another aspect combinable with the general implementation, another one of the plurality of the joint connectors may comprise a hollow main joint body, wherein a top portion of the upper supporting frame is coupled within the hollow main joint body and a middle portion of the upper supporting frame is received within the extension member.

In another aspect combinable with the general implementation, one of the plurality of the retaining members comprises a blocker arranged within the retaining receiving cavity and between a pair of the plurality of the first elastic sheets, wherein a front portion of another one of the plurality of the joint connectors is biased against the blocker to secure the another one of the plurality of the joint connectors within the retaining receiving cavity.

In another aspect combinable with the general implementation, in the second lock position, a pair of side joint bodies of another one of the plurality of the joint connectors may be inserted inside a pair of side receiving cavities, wherein a pair of the plurality of first elastic sheets of the retaining members are pressed by the pair of the side joint bodies of another one of the plurality of the joint connectors and biased against by the side joint bodies of another one of the plurality of the joint connectors to secure the pair of the side joint bodies of another one of the plurality of the joint connectors inside the pair of side receiving cavities.

In another aspect combinable with the general implementation, a pair of side joint bodies of another one of the plurality of the joint connectors may be rotatably received inside the pair of side receiving cavities to perform a closed position and an opened position for the shading structure, and a pair of side joint bodies of one of the plurality of the joint connectors are rotatably receiving inside a pair of side extension cavities to perform the closed position and the opened position.

In another aspect combinable with the general implementation, in the second unlock position, a pair of side joint bodies of another one of the plurality of the joint connectors are detached from a pair of side receiving cavities, wherein a pair of the plurality of first elastic sheets of the retaining member are reinstated to their original state after the pair of the side joint bodies of another one of the plurality of the joint connectors detach from the pair of side receiving cavities.

In another aspect combinable with the general implementation, the extension member comprises a main extension through hole configured to receive the upper supporting frame and a pair of side extension bodies having a pair of second elastic sheets received within a pair of side extension cavities, wherein the one of the plurality of the joint connectors comprises a hollow main joint body for receiving the lower supporting frame.

In another aspect combinable with the general implementation, in the first lock position, a pair of side joint bodies of one of the plurality of the joint connectors are pressed by a pair of second elastic sheets receiving inside a pair of side extension cavities formed by a pair of side extension bodies, wherein the pair of the second elastic sheets are biased against by the pair of side joint bodies of one the plurality of the joint connectors to secure the pair of side joint bodies of one of the plurality of the joint connectors inside the pair of the side extension cavities.

In another aspect combinable with the general implementation, one of a plurality of joint connectors comprises a protruded locker protruded from an outer surface of a hollow main joint body of the one of the plurality of the joint connectors and is configured to be inserted into the upper supporting frame or/and the lower supporting frame to secure the one of the plurality of the joint connectors with the upper supporting frame or/and the lower supporting frame.

In another aspect combinable with the general implementation, in the first unlock position, a pair of side joint bodies of one of the plurality of the joint connectors are detached from a pair of side extension cavities formed by a pair of side extension bodies, wherein a pair of the second elastic sheets are reinstated to their original state after the pair of the side joint bodies of one of the plurality of the joint connectors detach from the pair of side extension cavities.

Another aspect of the embodiment is directed to a method of installing a 3-in-1 connector system, comprising steps of:

in a second lock position, inserting a pair of side joint bodies of another one of a plurality of joint connectors inside a pair of side receiving cavities;

pressing a pair of a plurality of first elastic sheets of a retaining member of a base body by a pair of side joint bodies of another one of the plurality of the joint connectors;

biasing against the pair of the side joint bodies of another one of the plurality of joint connectors by the pair of the plurality of the first elastic sheets to secure the side joint bodies of another one of the joint connectors inside the pair of side receiving cavities;

in a first lock position, inserting a pair of side joint bodies of one of the plurality of the joint connectors inside a pair of side extension cavities formed by a pair of side extension bodies of an extension member;

pressing a pair of second elastic sheets by a pair of side joint bodies of one of the plurality of the joint connectors; and biasing against the pair of side joint bodies of one of the plurality of the joint connectors by the pair of second elastic sheets to secure the pair of side joint bodies of one of the plurality of the joint connectors inside the pair of the side extension cavities.

Among the many possible implementations of the method may further comprise steps of:

in a first unlock position, detaching the pair of side joint bodies of one of the plurality of the joint connectors from the pair of side extension cavities;

reinstating the pair of the second elastic sheets to their original state after the pair of the side joint bodies of one of the plurality of the joint connectors detach from the pair of side extension cavities;

in a second unlock position, detaching the pair of side joint bodies of another one of the plurality of the joint connectors from the pair of side receiving cavities; and reinstating the pair of the plurality of first elastic sheets of the retaining member to their original state after the pair of the side joint bodies of another one of the plurality of the joint connectors detach from the pair of the side receiving cavities.

Further, it is contemplated that the method may further comprise steps of:

deposing a main supporting pole into a central through hole of the base body;

receiving an upper supporting frame inside a main extension through hole of the extension member;

coupling one of the plurality of the joint connectors with a lower supporting frame; wherein the 3-in-1 connector system may comprise a plurality of retaining members axially arranged around the central through hole.

In the alternative, the method may comprise steps of: biasing against a front portion of another one of the plurality of the joint connectors by a blocker arranged within the retaining receiving cavity of the retaining member and between the pair of the plurality of the first elastic sheets to secure the another one of the plurality of the joint connectors within the retaining receiving cavity of the retaining member.

It is still further contemplated that the pair of side receiving cavities are symmetrically arranged on two sides of the retaining receiving cavity and one of the plurality of the first elastic sheets is arranged on one of the pair of the side receiving cavities, and another one of the plurality of the first elastic sheets is arranged on another one of the plurality of the side receiving cavities.

In another aspect combinable with the general implementation, one of the plurality of the joint connectors comprises a hollow main joint body, a front portion integrally extended from the hollow main joint body, and the pair of side joint bodies symmetrically formed on two sides of the front portion, wherein a top portion of the upper supporting frame is coupled within the hollow main joint body and a middle portion of the upper supporting frame is received within the extension member.

In another aspect combinable with the general implementation, the extension member comprises a pair of side extension bodies configured to form a pair of side extension cavities and the pair of second elastic sheets formed within the pair of side extension cavities.

In another aspect combinable with the general implementation, the method may further comprise steps of: inserting a protruded locker of the one of the plurality of the joint connectors into the upper supporting frame and/or the lower supporting frame to secure the one of the plurality of the joint connectors with the upper supporting frame or/and the lower supporting frame; wherein the protruded locker is protruded from an outer surface of a hollow main joint body of the one of the plurality of the joint connectors.

While this specification contains many specific implementation details, these should not be construed as limitations on the scope of any inventions or of what may be claimed, but rather as descriptions of features specific to particular implementations of particular inventions. Certain features that are described in this specification in the context of separate implementations can also be implemented in combination in a single implementation. Conversely, various features that are described in the context of a single implementation can also be implemented in multiple implementations separately or in any suitable subcombination. Moreover, although features may be described above and below as acting in certain combinations and even initially claimed as such, one or more features from a claimed combination can in some cases be excised from the combination, and the claimed combination may be directed to a subcombination or variation of a subcombination.

A number of implementations have been described. Nevertheless, it will be understood that various modifications may be made without departing from the spirit and scope of the disclosure. For example, example operations, methods, or processes described herein may include more steps or fewer steps than those described. Further, the steps in such example operations, methods, or processes may be performed in different successions than that described or illustrated in the figures. Accordingly, other implementations are within the scope of the following claims.

The details of one or more implementations of the subject matter described in this disclosure are set forth in the accompanying drawings and the description below. Other features, aspects, and advantages of the subject matter will become apparent from the description, the drawings, and the claims.

BRIEF DESCRIPTION OF THE DRAWINGS

It should be noted that the drawing figures may be in simplified form and might not be to precise scale. In reference to the disclosure herein, for purposes of convenience and clarity only, directional terms such as top, bottom, left, right, up, down, over, above, below, beneath, rear, front, distal, and proximal are used with respect to the accompanying drawings. Such directional terms should not be construed to limit the scope of the embodiment in any manner.

DETAILED DESCRIPTION OF THE EMBODIMENTS

The different aspects of the various embodiments can now be better understood by turning to the following detailed description of the embodiments, which are presented as illustrated examples of the embodiments defined in the claims. It is expressly understood that the embodiments as defined by the claims may be broader than the illustrated embodiments described below.

The term "a" or "an" entity refers to one or more of that entity. As such, the terms "a" (or "an"), "one or more" and "at least one" can be used interchangeably herein. It is also to be noted that the terms "comprising," "including," and "having" can be used interchangeably.

It shall be understood that the term "means," as used herein, shall be given its broadest possible interpretation in accordance with 35 U.S.C., Section 112 (f). Accordingly, a claim incorporating the term "means" shall cover all structures, materials, or acts set forth herein, and all of the equivalents thereof. Further, the structures, materials or acts and the equivalents thereof shall include all those described in the summary of the invention, brief description of the drawings, detailed description, abstract, and claims themselves.

Unless defined otherwise, all technical and position terms used herein have the same meaning as commonly understood by one of ordinary skill in the art to which the invention pertains. Although many methods and materials similar, modified, or equivalent to those described herein can be used in the practice of the present invention without undue experimentation, the preferred materials and methods are described herein. In describing and claiming the present invention, the following terminology will be used in accordance with the definitions set out below.

Figure 1:
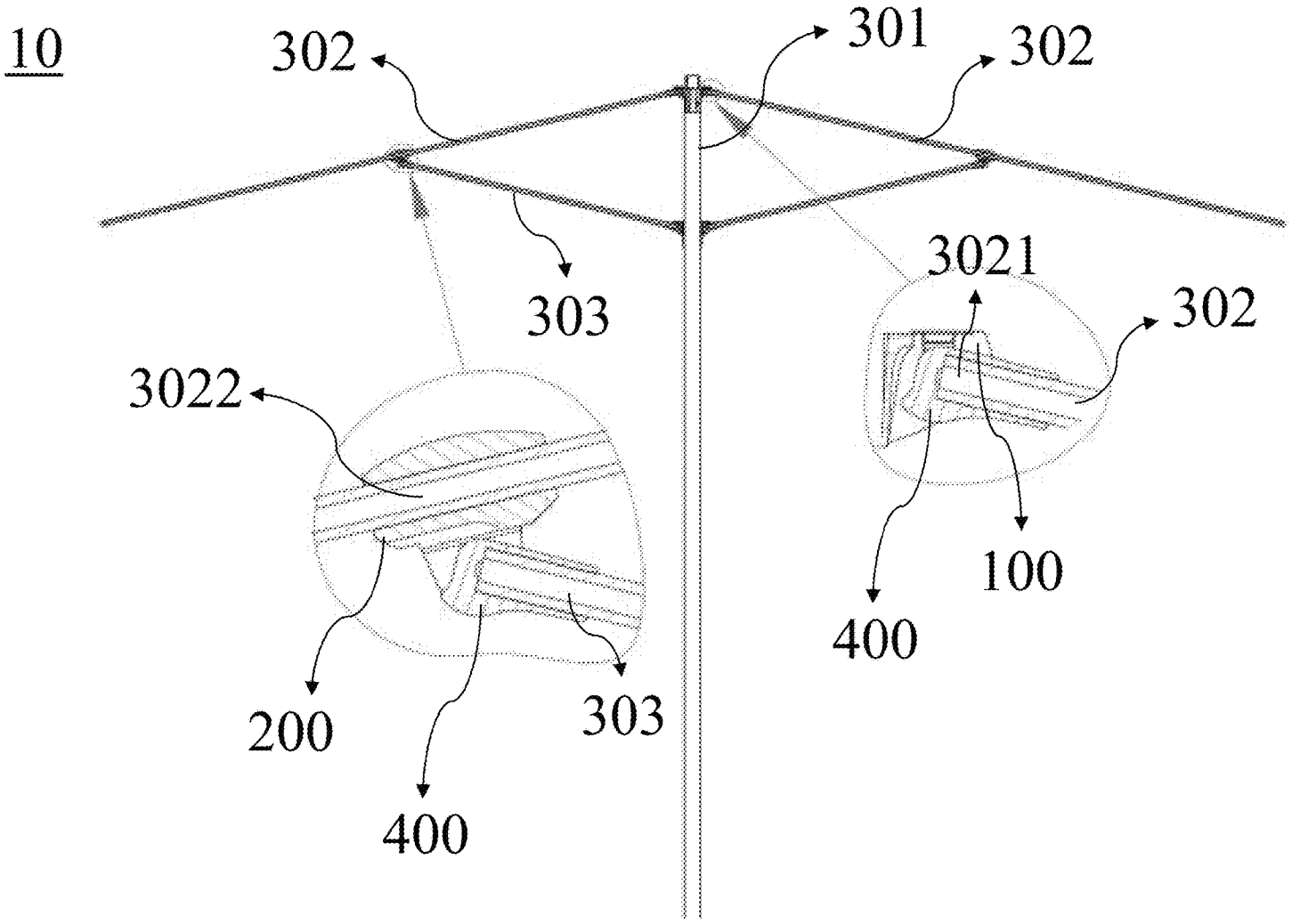
FIG. 1 is a perspective view of a 3-in-1 connector system for a shading structure according to an aspect of the embodiment.
Figure 2:
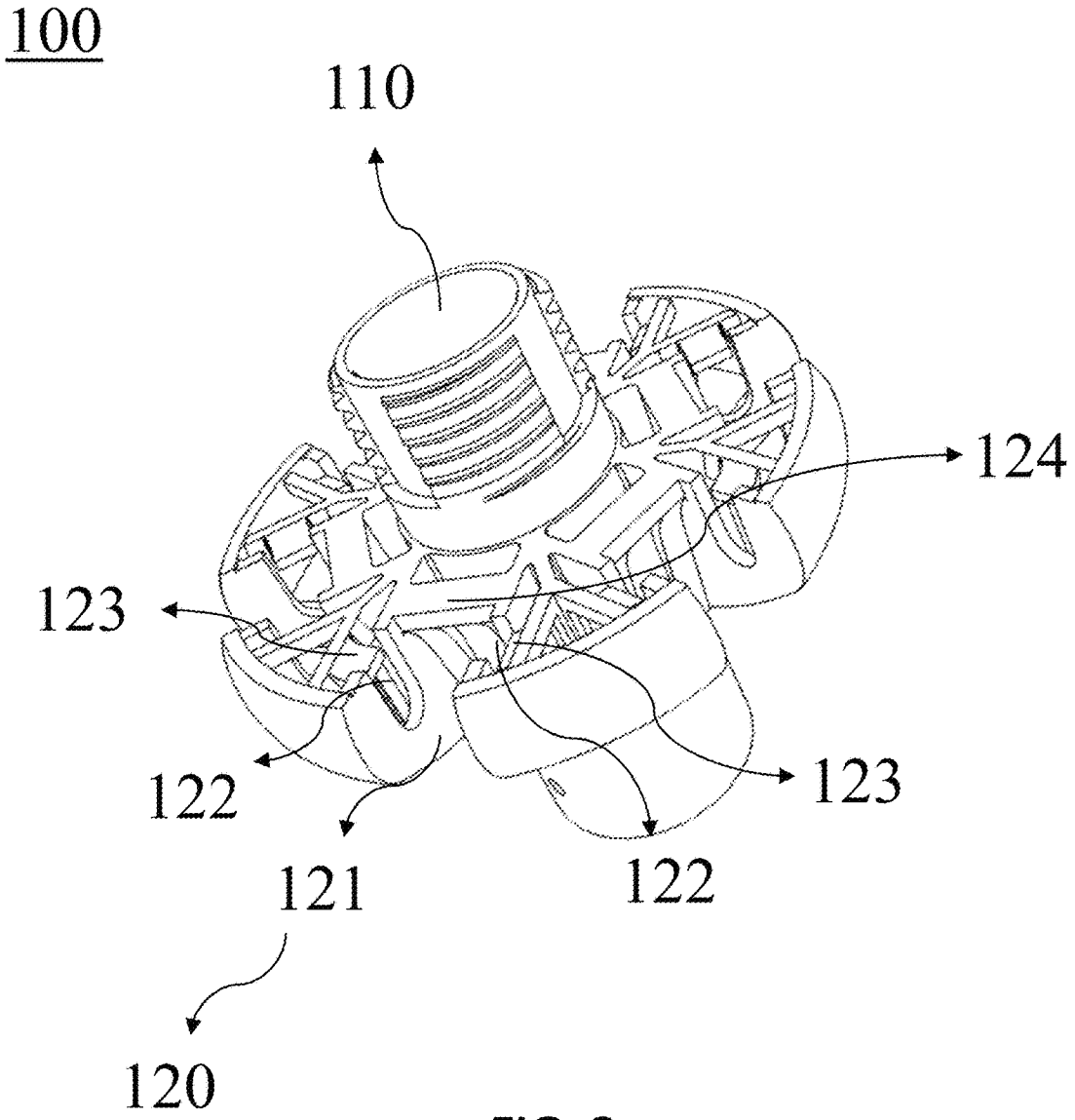
FIG. 2 is a perspective view of the 3-in-1 connector system for the shading structure according to an aspect of the embodiment.
Figure 3:
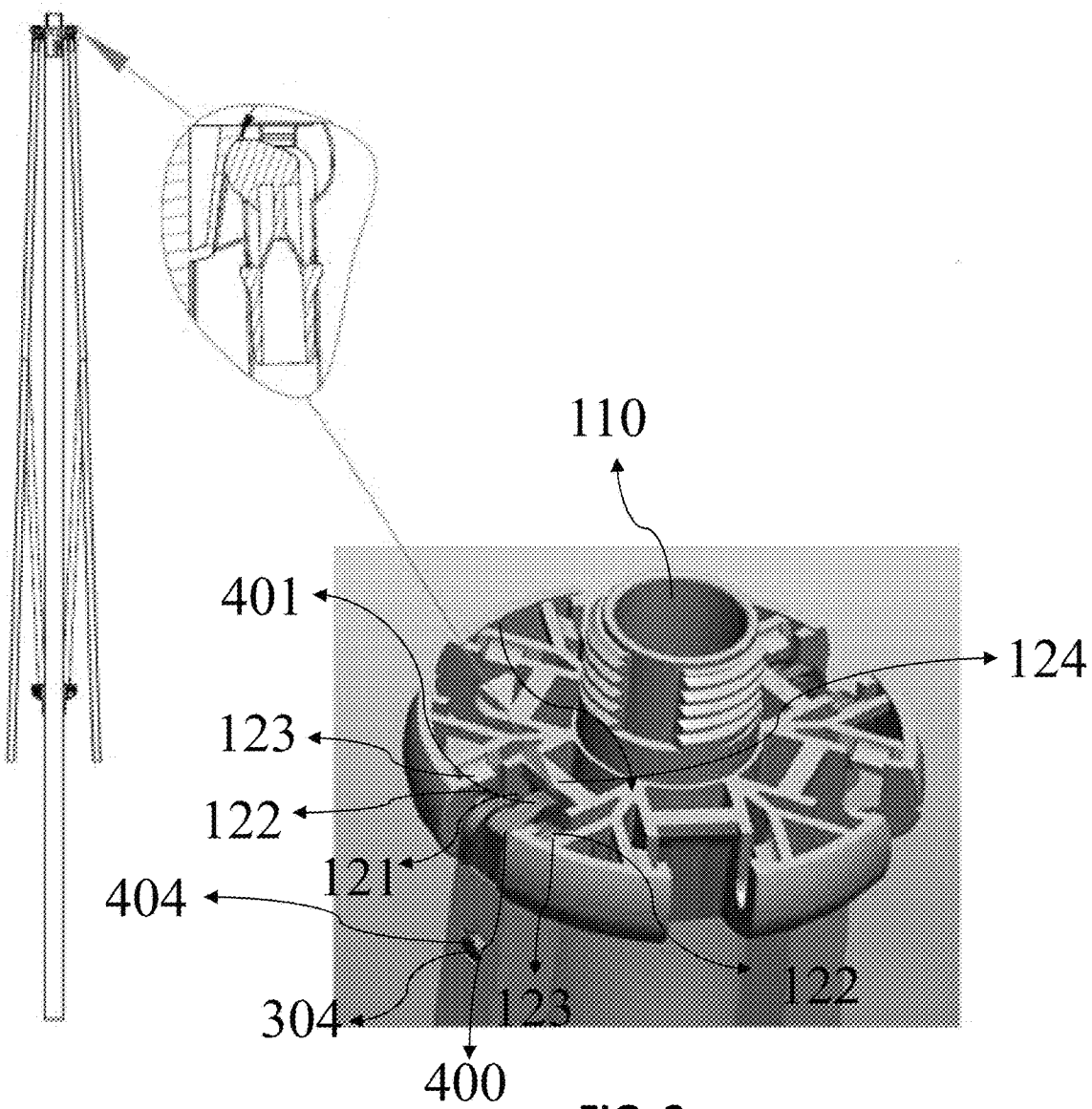
FIG. 3 is a top view of the 3-in-1 connector system showing a base body cooperated with an upper supporting frame in a closed position for the shading structure according to an aspect of the embodiment.

FIGS. 1-3 generally depict a 3-in-1 connector system 10 for a shading structure according to an aspect of the embodiments.

Referring to FIG. 1, the 3-in-1 connector system 10 may comprise a base body 100 configured to support a main supporting pole 301 of the shading structure with an upper supporting frame 302 and an extension member 200 configured to support the upper supporting frame 302 with a lower supporting frame 303.

Continuing to FIG. 1, in some embodiments, the 3-in-1 connector system 10 may further comprise a plurality of joint connectors 400, wherein one of the plurality of the joint connectors 400 may be coupled with the extension member 200 and the lower supporting frame 303 to form a first lock position and a first unlock position, and another one of the plurality of the joint connectors 400 may be coupled with the base body 100 and the upper supporting frame 302.

Referring to FIG. 2, the base body 100 may comprise a central through hole 110 for deposing the main supporting pole 301 and a plurality of retaining members 120 axially arranged around the central through hole 110. In some embodiments, each of the plurality of the retaining members 120 may comprise a retaining receiving cavity 121 and a pair of side receiving cavities 122 symmetrically arranged on two sides of the retaining receiving cavity 121.

In still some embodiments, the retaining member 120 may comprise a plurality of first elastic sheets 123 configured to perform a second lock position and a second unlock position, wherein one of the plurality of the first elastic sheets 123 is arranged on one of the pair of the side receiving cavities 122 and another one of the plurality of the first elastic sheets 123 is arranged on another one of the plurality of the side receiving cavities 122.

Referring to FIG. 3, the another one of the plurality of the joint connectors 400 may be received and secured inside the retaining receiving cavity 121.

Continuing to FIGS. 2 and 3, in still some embodiments, one of the plurality of the retaining members 120 may comprise a blocker 124 arranged within the retaining receiving cavity 121 and between a pair of the plurality of the first elastic sheets 123, wherein the blocker 124 may be inwardly and integrally extended towards the retaining receiving cavity 121.

As shown in further details in FIG. 3, the shading structure may be performed in an closed position, wherein in the closed position, a front portion 401 of another one of the plurality of the joint connectors 400 may be biased against the blocker 124 to secure the another one of the plurality of the joint connectors 400 within the retaining receiving cavity 121.

Figure 4B:
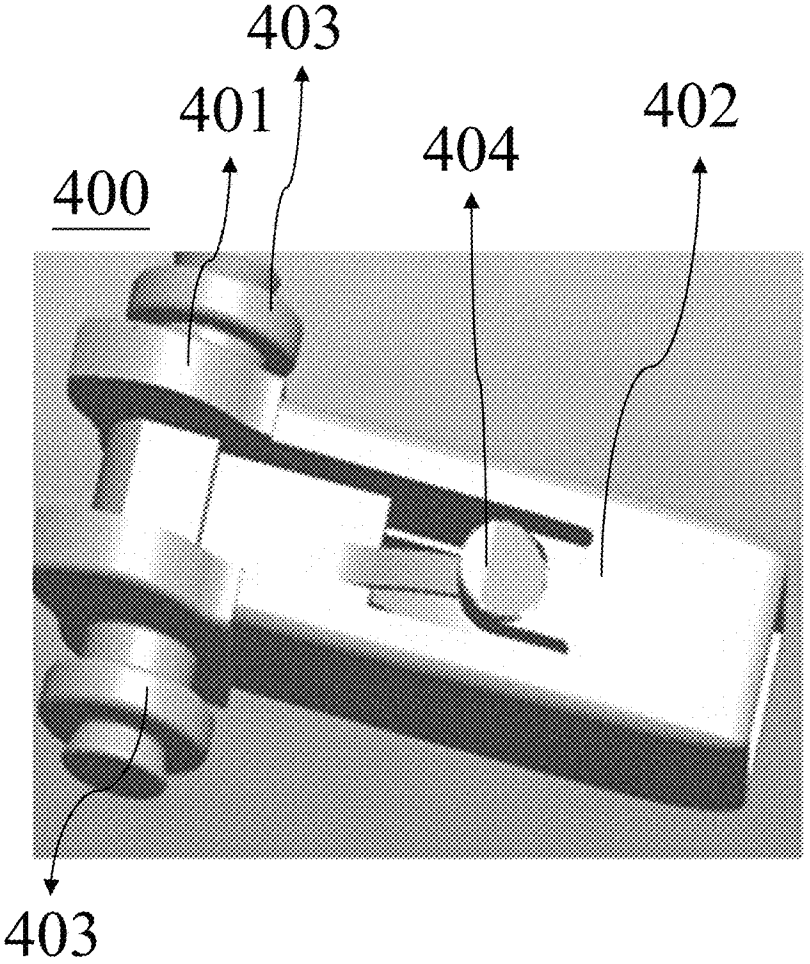
FIG. 4A and FIG. 4B are perspective views of a joint connector according to an aspect of the embodiment.
Figure 4A:
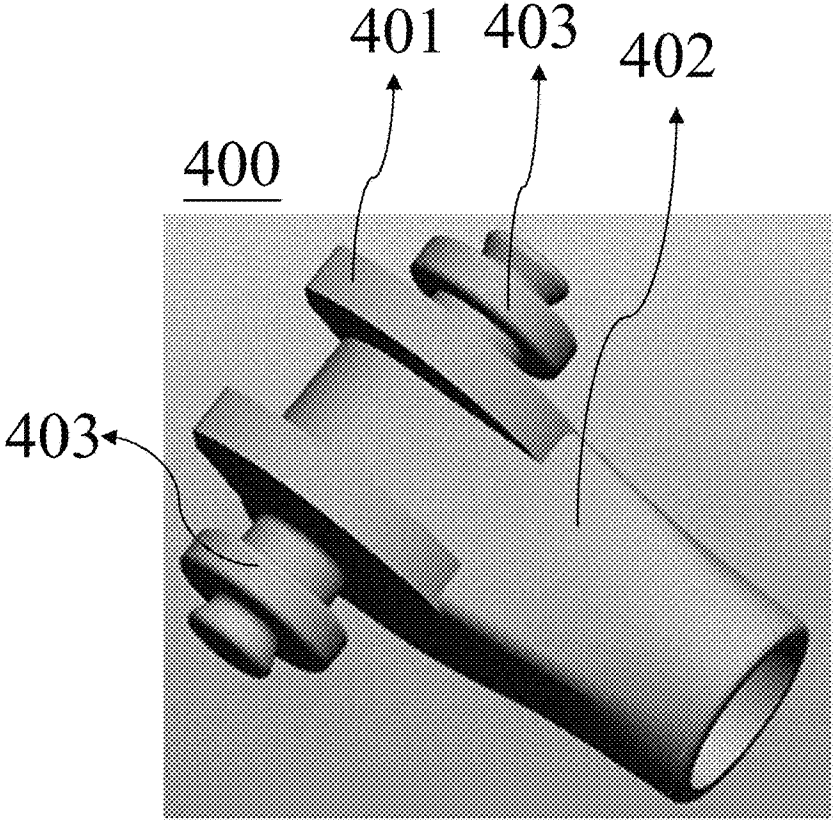

FIGS. 4A and 4B generally depict the joint connector 400 according to an aspect of the embodiments.

Referring to FIGS. 4A and 4B, in some embodiments, one of the plurality of the joint connectors 400 comprises a hollow main joint body 402, the front portion 401 integrally extended from the hollow main joint body 402, and a pair of side joint bodies 403 symmetrically and integrally extended from the front portion 401 and formed on two sides of the front portion 401.

Referring back to FIGS. 1, 3, 4A and 4B, one of the plurality of the joint connectors 400 may comprise the hollow main joint body 402, wherein a top portion 3021 of the upper supporting frame 302 may be coupled within the hollow main joint body 402 and a middle portion 3022 of the upper supporting frame 302 may be received within the extension member 200.

It should be noted that, in some embodiments, each of the pair of the side joint bodies 403 of another one of the plurality of the joint connectors 400 may be slid to be received inside each of a pair of side receiving cavities 122 in order to secure the another one of the plurality of the joint connectors 400 with the base body 100.

Continuing to FIG. 3 and FIG. 4B, the one of the plurality of joint connectors 400 may comprise a protruded locker 404 protruded from an outer surface of the hollow main joint body 402 of one of the plurality of the joint connectors 400 and configured to be inserted into the upper supporting frame 302 or/and the lower supporting frame 303 to secure the one of the plurality of the joint connectors 400 with the upper supporting frame 302 or/and the lower supporting frame 303.

It should be noted that, in some embodiments, the upper supporting frame 302 or/and the lower supporting frame 303 may comprise at least one locking through hole 304 configured to receive the protruded locker 404 and to secure the one of the plurality of the joint connectors 400 with the upper supporting frame 302 or/and the lower supporting frame 303.

Figure 5:
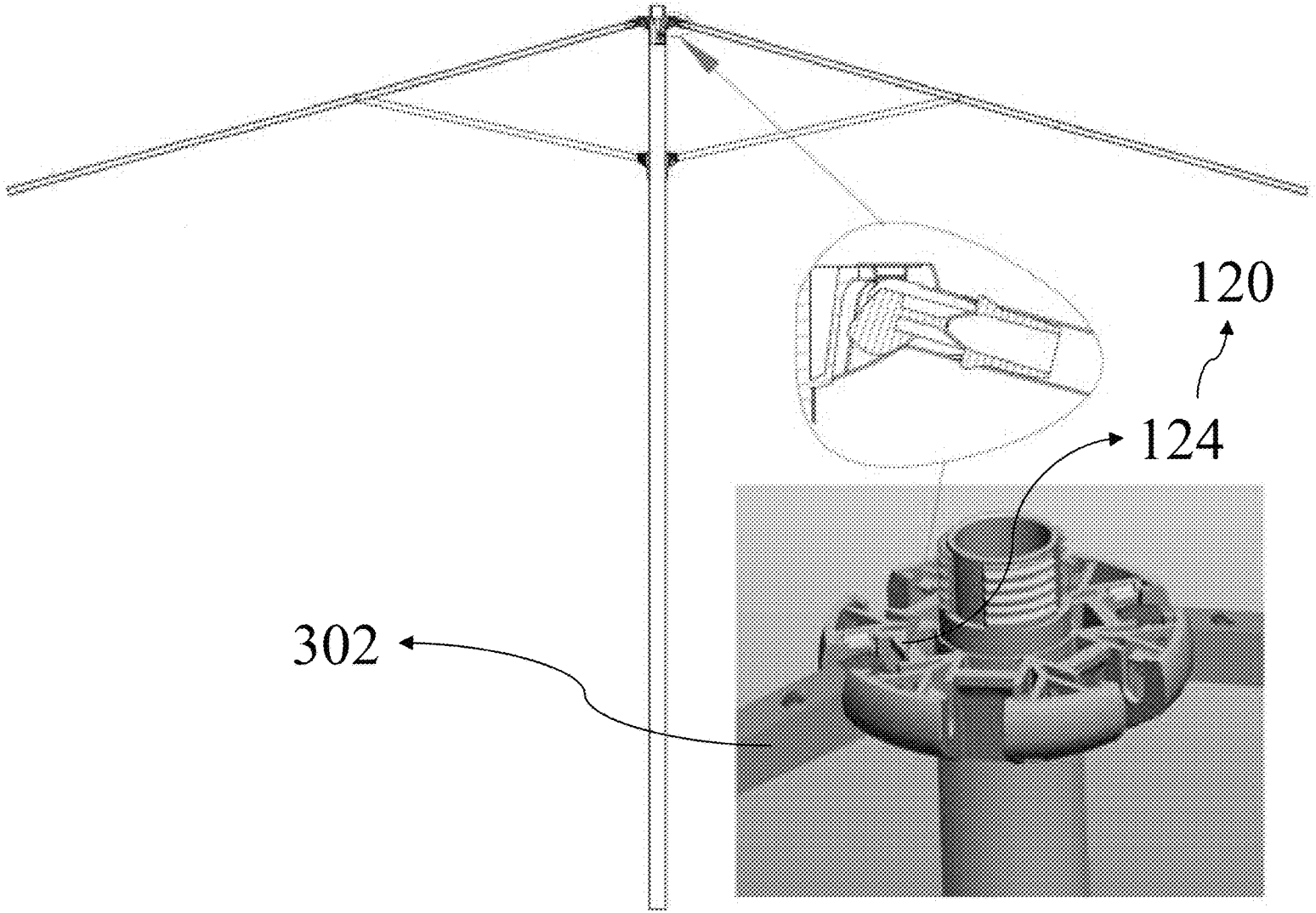
FIG. 5 is a perspective view of the 3-in-1 connector system showing the base body cooperated with an upper supporting frame in an opened position for the shading structure according to an aspect of the embodiment.

FIG. 5 generally depicts the shading structure in an opened position according to an aspect of the embodiments.

Referring to FIG. 5, when the shading structure is in an opened position, the front portion 401 of another one of the plurality of the joint connectors 400 may not be biased against the blocker 124 of the retaining member 120, and in such a way, the upper supporting frame 302 may be expanded without being blocking by the blocker 124 of the retaining member 120.

It should be noted that, as shown in FIG. 3 and FIG. 5, while the retaining member 120 is in the second lock position, the pair of side joint bodies 403 of another one of the joint connectors 400 may be inserted inside the pair of side receiving cavities 122, wherein the pair of the plurality of first elastic sheets 123 of the retaining members 120 may be pressed by the pair of the side joint bodies 403 of another one of the plurality of the joint connectors 400 and be biased against by the side joint bodies 403 of another one of the plurality of the joint connectors 400 to secure the side joint bodies 403 of another one of the plurality of the joint connectors 400 inside the pair of side receiving cavities 122.

Continuing to FIG. 3 and FIG. 5, the pair of side joint bodies 403 of another one of the plurality of the joint connectors 400 are rotatably received inside the pair of side receiving cavities 122 to perform a closed position, as shown in FIG. 3 and an opened position, as shown in FIG. 5.

In other words, in some embodiments, while the retaining member 120 is on the second unlock position, the pair of side joint bodies 403 of another one of the plurality of the joint connectors 400 may be detached from the pair of side receiving cavities 122, wherein the pair of the plurality of first elastic sheets 123 of the retaining member 120 may be reinstated to their original state after the pair of the side joint bodies 403 of another one of the plurality of the joint connectors 400 detach from the pair of side receiving cavities 122.

Figure 6:
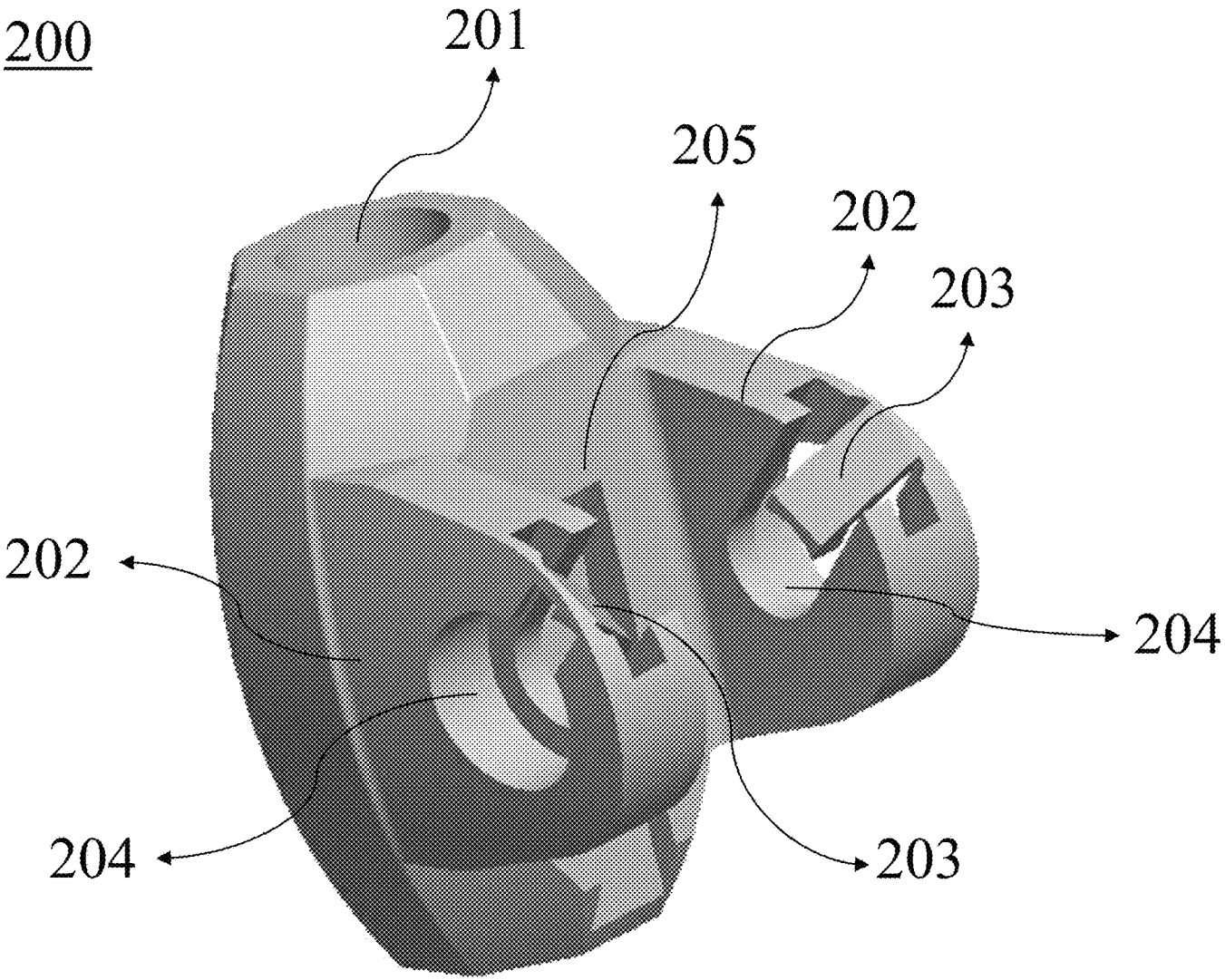
FIG. 6 is a perspective view of an extension member according to an aspect of the embodiment.

FIG. 6 generally depicts the extension member 200 according to an aspect of the embodiments.

Referring to FIG. 6 and back to FIGS. 1, 4A, and 4B, the extension member 200 may comprise a main extension through hole 201 configured to receive the upper supporting frame 302 and a pair of side extension bodies 202 having a pair of second elastic sheets 203 received within a pair of side extension cavities 204.

In some embodiments, the extension member 200 may comprise an extension receiving cavity 205 formed between the pair of the side extension bodies 202, wherein the pair of side joint bodies 403 of one of the plurality of the joint connectors 400 may be received inside the side extension cavities 204, and in such a way, the lower supporting frame 303 may be received within the hollow main joint body 402 of the one of the plurality of the joint connectors 400.

In some embodiments, while the extension member 200 is in the first lock position, a pair of side joint bodies 403 of one of the plurality of the joint connectors 400 may be pressed by the pair of second elastic sheets 203 receiving inside the pair of side extension cavities 204 formed by the pair of side extension bodies 202, wherein the pair of the second elastic sheets 203 may be biased against by the pair of side joint bodies 403 of one of the plurality of the joint connectors 400 to secure the pair of side joint bodies 403 of one of the plurality of the joint connectors 400 inside the pair of the side extension cavities 204.

In still some embodiments, while the extension member 200 is in the first unlock position, the pair of side joint bodies 403 of one of the plurality of the joint connectors 400 may be detached from the pair of side extension cavities 204 formed by the pair of side extension bodies 202, wherein the pair of the second elastic sheets 203 may reinstate to their original state after the pair of the side joint bodies 403 of one of the plurality of the joint connectors 400 detach from the pair of side extension cavities 204.

In still some embodiments, the pair of side joint bodies 403 of one of the plurality of the joint connectors 400 may be rotatably receiving inside the pair of side extension cavities 204 to perform the closed position and the opened position.

Figure 7:
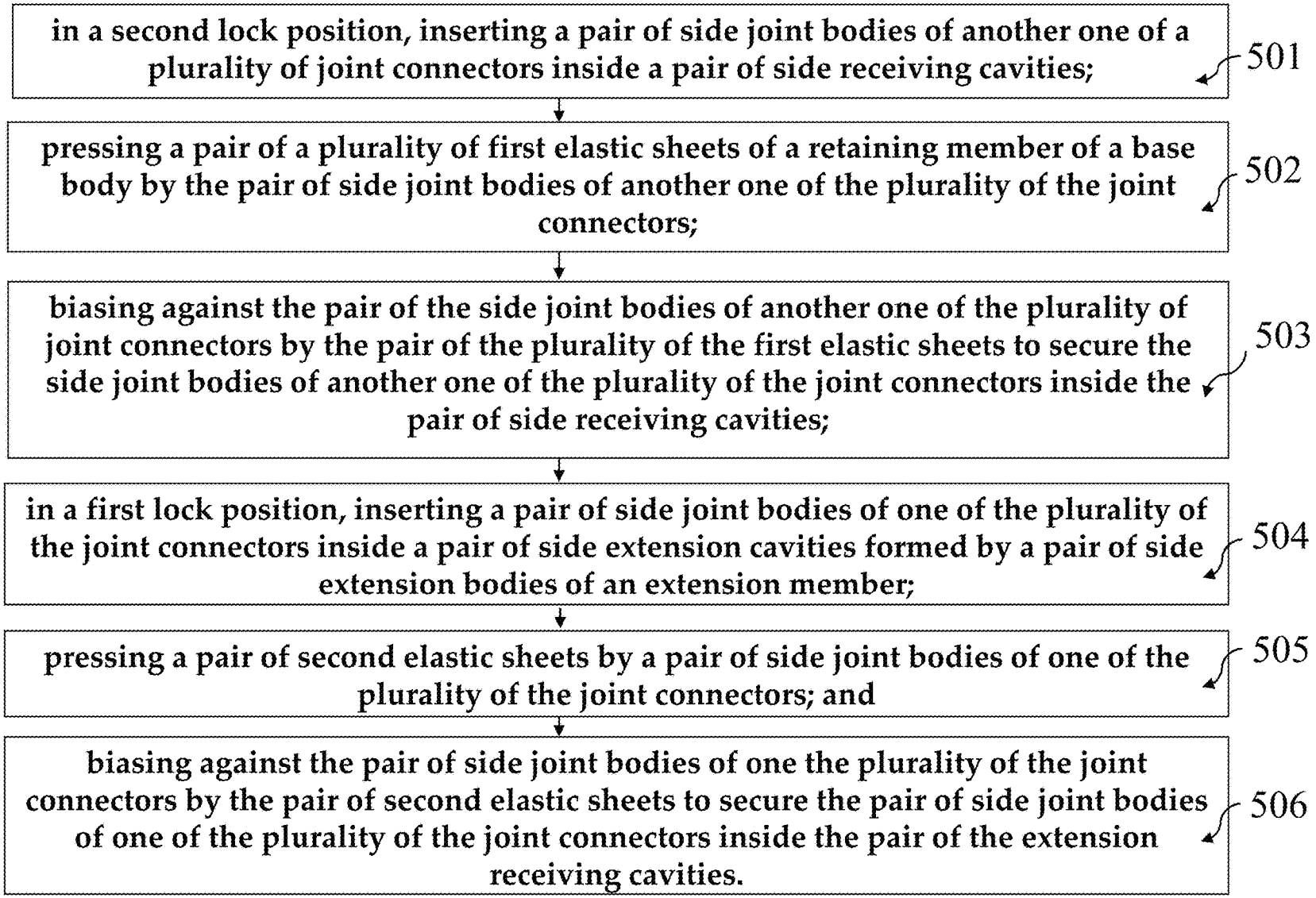
FIGS. 7-9 illustrates a method for installing the 3-in-1 connector system for the shading structure according to an aspect of the embodiment.
Figure 8:
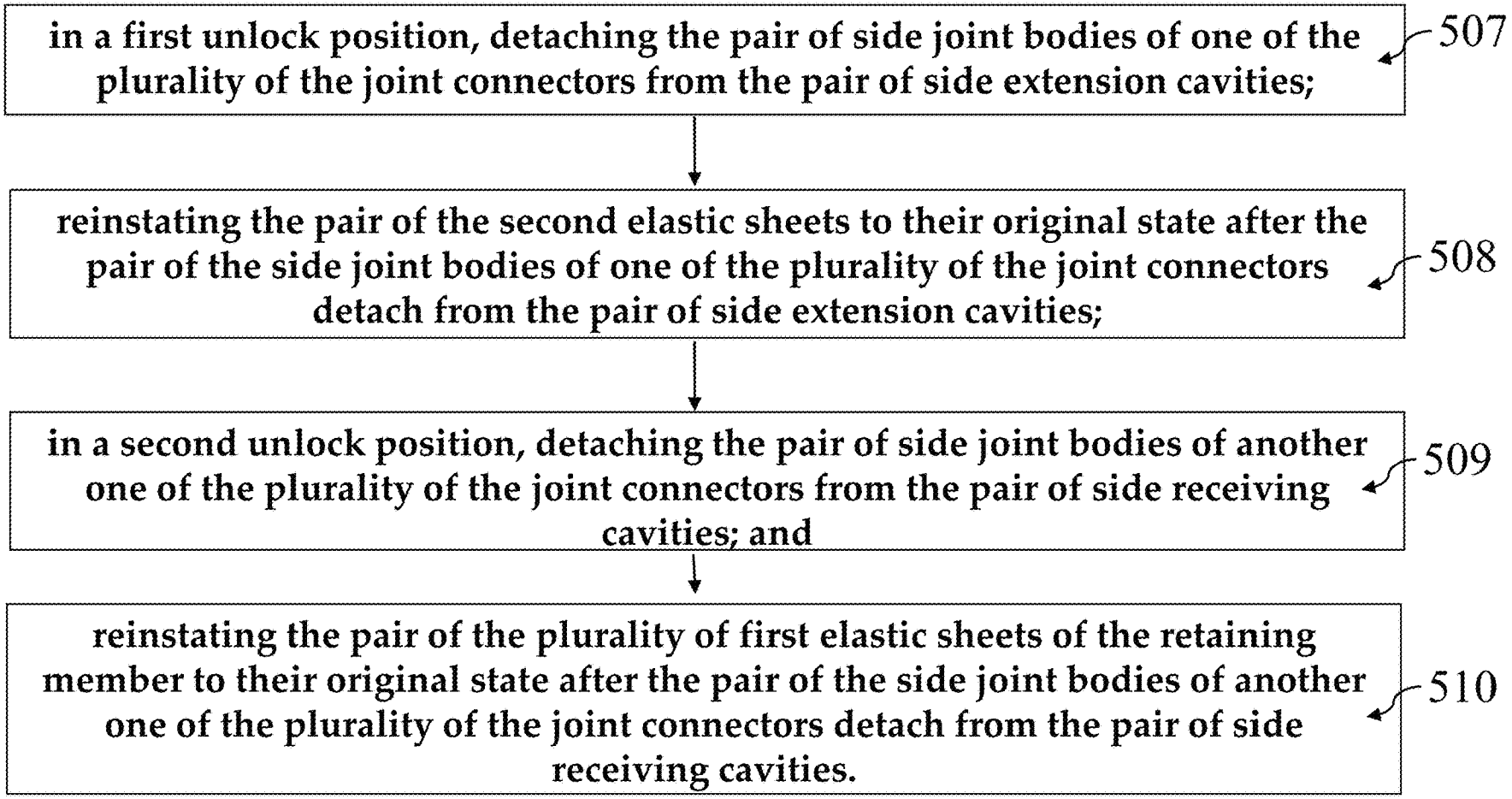
Figure 9:
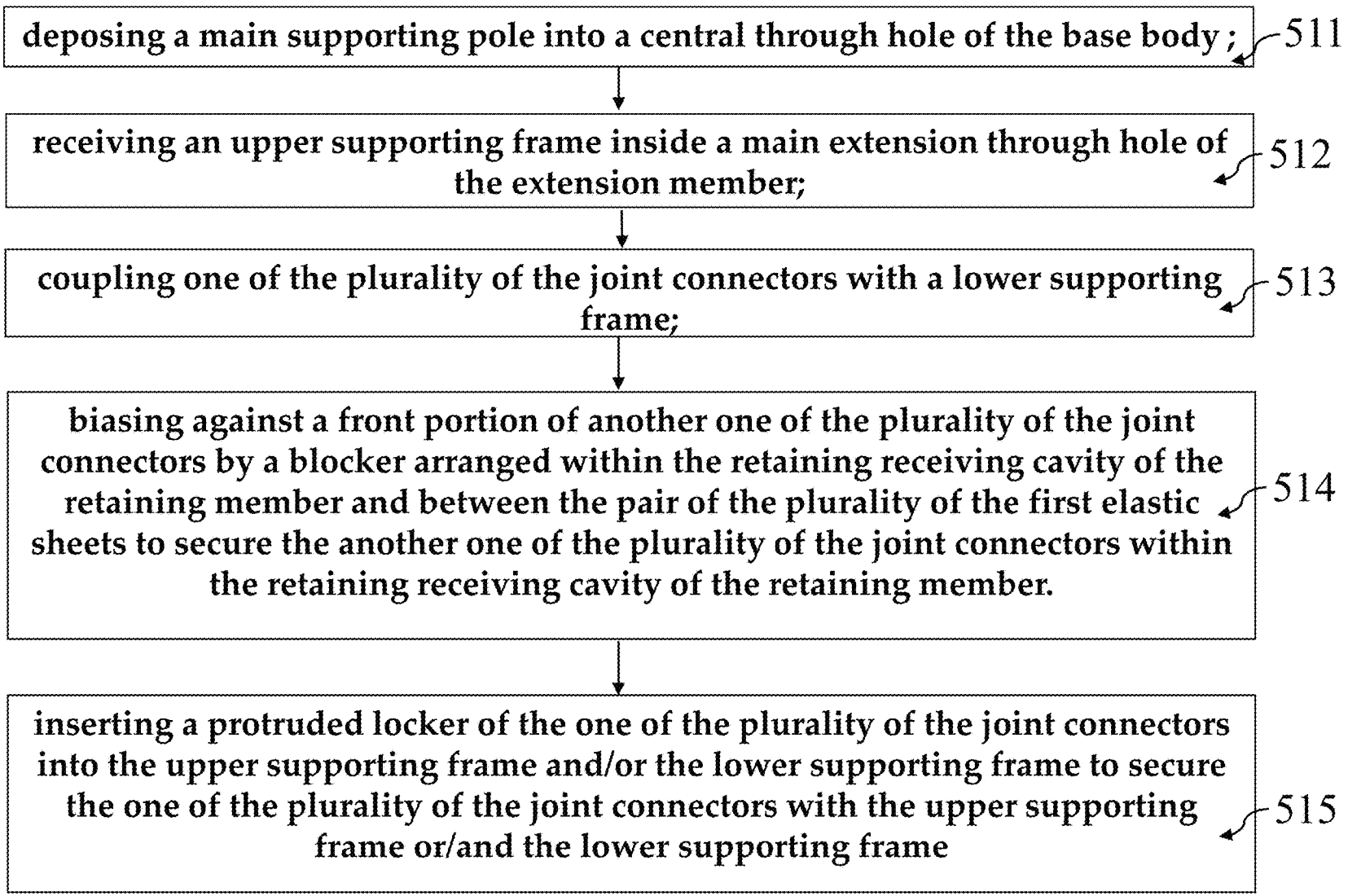

FIGS. 7-9 generally depict a method for installing the 3-in-1 connector system for the shading structure according to an aspect of the embodiments.

As shown in FIG. 7, in some embodiments, the method 500 may comprise steps of:

in a second lock position, inserting a pair of side joint bodies of another one of a plurality of joint connectors inside a pair of side receiving cavities 501;

pressing a pair of a plurality of first elastic sheets of a retaining member of a base body by the pair of side joint bodies of another one of the plurality of the joint connectors 502;

biasing against the pair of the side joint bodies of another one of the plurality of joint connectors by the pair of the plurality of the first elastic sheets to secure the side joint bodies of another one of the plurality of the joint connectors inside the pair of side receiving cavities 503;

in a first lock position, inserting a pair of side joint bodies of one of the plurality of the joint connectors inside a pair of side extension cavities formed by a pair of side extension bodies of an extension member 504;

pressing a pair of second elastic sheets by a pair of side joint bodies of one of the plurality of the joint connectors 505; and biasing against the pair of side joint bodies of one of the plurality of the joint connectors by the pair of second elastic sheets to secure the pair of side joint bodies of one of the plurality of the joint connectors inside the pair of the side extension cavities 506.

Continuing to FIG. 8, the method may further comprise steps of:

in a first unlock position, detaching the pair of side joint bodies of one of the plurality of the joint connectors from the pair of side extension cavities 507;

reinstating the pair of the second elastic sheets to their original state after the pair of the side joint bodies of one of the plurality of the joint connectors detach from the pair of side extension cavities 508;

in a second unlock position, detaching the pair of side joint bodies of another one of the plurality of the joint connectors from the pair of side receiving cavities 509; and reinstating the pair of the plurality of first elastic sheets of the retaining member to their original state after the pair of the side joint bodies of another one of the plurality of the joint connectors detach from the pair of side receiving cavities 510.

Referring to FIG. 9, the method may further comprise steps of:

deposing a main supporting pole into a central through hole of the base body 511;

receiving an upper supporting frame inside a main extension through hole of the extension member 512;

coupling one of the plurality of the joint connectors with a lower supporting frame 513; wherein the base body comprises a plurality of retaining members axially arranged around the central through hole.

Continuing to FIG. 9, the method may further comprise steps of: biasing against a front portion of another one of the plurality of the joint connectors by a blocker arranged within the retaining receiving cavity of the retaining member and between the pair of the plurality of the first elastic sheets to secure the another one of the plurality of the joint connectors within the retaining receiving cavity of the retaining member 514.

In some embodiments, the pair of side receiving cavities may be symmetrically arranged on two sides of the retaining receiving cavity and one of the plurality of the first elastic sheets is arranged on one of the pair of the side receiving cavities, and another one of the plurality of the first elastic sheets is arranged on another one of the plurality of the side receiving cavities.

In still some embodiments, one of the plurality of the joint connectors may comprise a hollow main joint body, a front portion integrally extended from the hollow main joint body, and the pair of side joint bodies symmetrically formed on two sides of the front portion, wherein a top portion of the upper supporting frame is coupled within the hollow main joint body and a middle portion of the upper supporting frame is received within the extension member.

In still some embodiments, the extension member may comprise a pair of side extension bodies configured to form a pair of side extension cavities and the pair of second elastic sheets are formed within the pair of side extension cavities.

As shown in further details in FIG. 9, the method may further comprise steps of: inserting a protruded locker of the one of the plurality of the joint connectors into the upper supporting frame and/or the lower supporting frame to secure the one of the plurality of the joint connectors with the upper supporting frame or/and the lower supporting frame 515; wherein the protruded locker is protruded from an outer surface of a hollow main joint body of the one of the plurality of the joint connectors.

Similarly, while operations and/or methods may be depicted in the drawings in a particular order, this should not be understood as requiring that such operations be performed in the particular order shown or in sequential order, or that all illustrated operations and/or methods steps be performed, to achieve desirable results. In certain circumstances, multitasking and parallel processing may be advantageous.

Many alterations and modifications may be made by those having ordinary skill in the art without departing from the spirit and scope of the disclosed embodiments. Therefore, it must be understood that the illustrated embodiments have been set forth only for the purposes of example and that it should not be taken as limiting the embodiments as defined by the following claims. For example, notwithstanding the fact that the elements of a claim are set forth below in a certain combination, it must be expressly understood that the embodiment includes other combinations of fewer, more, or different elements, which are disclosed herein even when not initially claimed in such combinations.

Thus, specific embodiments and applications of 3-in-1 connector system for the shading structure have been disclosed. It should be apparent, however, to those skilled in the art that many more modifications besides those already described are possible without departing from the disclosed concepts herein. The disclosed embodiments, therefore, is not to be restricted except in the spirit of the appended claims. Moreover, in interpreting both the specification and the claims, all terms should be interpreted in the broadest possible manner consistent with the context. In particular, the terms "comprises" and "comprising" should be interpreted as referring to elements, components, or steps in a non-exclusive manner, indicating that the referenced elements, components, or steps may be present, or utilized, or combined with other elements, components, or steps that are not expressly referenced. Insubstantial changes from the claimed subject matter as viewed by a person with ordinary skill in the art, now known or later devised, are expressly contemplated as being equivalent within the scope of the claims. Therefore, obvious substitutions now or later known to one with ordinary skill in the art are defined to be within the scope of the defined elements. The claims are thus to be understood to include what is specifically illustrated and described above, what is conceptually equivalent, what can be obviously substituted and also what essentially incorporates the essential idea of the embodiments. In addition, where the specification and claims refer to at least one of something selected from the group consisting of A, B, C . . . and N, the text should be interpreted as requiring at least one element from the group which includes N, not A plus N, or B plus N, etc.

The words used in this specification to describe the various embodiments are to be understood not only in the sense of their commonly defined meanings, but to include by special definition in this specification structure, material or acts beyond the scope of the commonly defined meanings. Thus, if an element can be understood in the context of this specification as including more than one meaning, then its use in a claim must be understood as being generic to all possible meanings supported by the specification and by the word itself.

The definitions of the words or elements of the following claims therefore include not only the combination of elements which are literally set forth, but all equivalent structure, material or acts for performing substantially the same function in substantially the same way to obtain substantially the same result. In this sense it is therefore contemplated that an equivalent substitution of two or more elements may be made for any one of the elements in the claims below or that a single element may be substituted for two or more elements in a claim. Although elements may be described above as acting in certain combinations and even initially claimed as such, it is to be expressly understood that one or more elements from a claimed combination can in some cases be excised from the combination and that the claimed combination may be directed to a subcombination or variation of a subcombination.

What is claimed is:

1. A 3-in-1 connector system for a shading structure, comprising, a base body comprises a central through hole for deposing a main supporting pole and a plurality of retaining members axially arranged around the central through hole and one of the plurality of the retaining members comprises a retaining receiving cavity;

a plurality of joint connectors;

an extension member having at least one second elastic sheets and an extension receiving cavity for receiving and securing one of the plurality of the joint connectors with a lower supporting frame to form a first lock position and a first unlock position; wherein another one of the plurality of the joint connectors is receiving and securing inside the retaining receiving cavity;

one of the plurality of the retaining members comprises a plurality of first elastic sheets configured to perform a second lock position and a second unlock position; wherein each of the plurality of the joint connectors comprises a hollow main joint body, a front portion integrally extended from the hollow main joint body, and a pair of side joint bodies symmetrically formed on two sides of the front portion, wherein each of the pair of the side joint bodies is slid to be received inside each of a pair of side receiving cavities of one of the plurality of the retaining members.

2. The 3-in-1 connector system of claim 1, wherein one of the plurality of the retaining members comprises a pair of side receiving cavities symmetrically arranged on two sides of the retaining receiving cavity and one of the plurality of the first elastic sheets is arranged on one of the pair of the side receiving cavities of the one of the plurality of the retaining member and another one of the plurality of the first elastic sheets is arranged on another one of the pair of the side receiving cavities of the one of the plurality of the retaining member.

3. The 3-in-1 connector system of claim 1, wherein another one of the plurality the joint connectors comprises a hollow main joint body, wherein a top portion of an upper supporting frame is coupled within the hollow main joint body and a middle portion of the upper supporting frame is received within the extension member.

4. The 3-in-1 connector system of claim 1, wherein one of the plurality of the retaining members comprises a blocker arranged within the retaining receiving cavity and between a pair of the plurality of the first elastic sheets, wherein a front portion of another one of the plurality of the joint connectors is biased against by the blocker to secure the another one of the plurality of the joint connectors within the retaining receiving cavity.

5. The 3-in-1 connector system of claim 1, wherein, in the second lock position, a pair of side joint bodies of another one of the plurality of the joint connectors are inserted inside a pair of side receiving cavities of one of the plurality of the retaining members, wherein a pair of the plurality of first elastic sheets of the retaining member are pressed by the pair of the side joint bodies of another one of the plurality of the joint connectors and be biased against by the side joint bodies of another one of the plurality of the joint connectors to secure the pair of the side joint bodies of another one of the plurality of the joint connectors inside the pair of side receiving cavities.

6. The 3-in-1 connector system of claim 1, wherein a pair of side joint bodies of another one of the plurality of the joint connectors are rotatably received inside a pair of side receiving cavities of one of the plurality of the retaining members to perform a closed position and an opened position for the shading structure, and a pair of side joint bodies of one of the plurality of the joint connectors are rotatably receiving inside a pair of side extension cavities of the extension member to perform the closed position and the opened position.

7. The 3-in-1 connector system of claim 1, wherein, in the second unlock position, a pair of side joint bodies of another one of the plurality of the joint connectors are detached from a pair of side receiving cavities of one of the plurality of the retaining members, wherein a pair of the plurality of first elastic sheets of the retaining member are reinstated to their original state after the pair of the side joint bodies of another one of the plurality of the joint connectors detach from the pair of side receiving cavities.

8. The 3-in-1 connector system of claim 1, wherein the extension member comprises a main extension through hole configured to receive the upper supporting frame and a pair of side extension bodies having the pair of second elastic sheets received within a pair of side extension cavities, wherein the one of the plurality of the joint connectors comprises a hollow main joint body for receiving the lower supporting frame.

9. The 3-in-1 connector system of claim 1, wherein in the first lock position, a pair of side joint bodies of one of the plurality of the joint connectors are pressed by a pair of the plurality of the second elastic sheets receiving inside a pair of side extension cavities formed by a pair of side extension bodies of the extension member, wherein the pair of the second elastic sheets are biased against by the pair of side joint bodies of one the plurality of the joint connectors to secure the pair of side joint bodies of one of the plurality of the joint connectors inside the pair of the side extension cavities.

10. The 3-in-1 connector system of claim 1, wherein one of the plurality of joint connectors comprises a protruded locker protruded from an outer surface of a hollow main joint body of the one of the plurality of the joint connectors and configured to be inserted into an upper supporting frame or/and the lower supporting frame to secure the one of the plurality of the joint connectors with the upper supporting frame or/and the lower supporting frame.

11. The 3-in-1 connector system of claim 1, wherein in the first unlock position, a pair of side joint bodies of one of the plurality of the joint connectors are detached from a pair of side extension cavities formed by a pair of side extension bodies of the extension member, wherein the pair of the second elastic sheets are reinstated to their original state after the pair of the side joint bodies of one of the plurality of the joint connectors detach from the pair of side extension cavities.

12. A method for installing a 3-in-1 connector system, comprising, in a second lock position, inserting a pair of side joint bodies of another one of a plurality of joint connectors inside a pair of side receiving cavities of a retaining member;

pressing a pair of a plurality of first elastic sheets of the retaining member of a base body by a pair of side joint bodies of another one of the plurality of the joint connectors;

biasing against the pair of the side joint bodies of another one of the plurality of joint connectors by the pair of the plurality of the first elastic sheets to secure the side joint bodies of another one of the plurality of the joint connectors inside the pair of side receiving cavities;

in a first lock position, inserting a pair of side joint bodies of one of the plurality of the joint connectors inside a pair of side extension cavities formed by a pair of side extension bodies of an extension member;

pressing a pair of second elastic sheets by a pair of side joint bodies of one of the plurality of the joint connectors; and biasing against the pair of side joint bodies of one the plurality of the joint connectors by the pair of second elastic sheets to secure the pair of side joint bodies of one of the plurality of the joint connectors inside the pair of the side extension cavities.

13. The method of claim 12, further comprising steps of:

in a first unlock position, detaching the pair of side joint bodies of one of the plurality of the joint connectors from the pair of side extension cavities;

reinstating the pair of the second elastic sheets to their original state after the pair of the side joint bodies of one of the plurality of the joint connectors detach from the pair of side extension cavities;

in a second unlock position, detaching the pair of side joint bodies of another one of the plurality of the joint connectors from the pair of side receiving cavities; and reinstating the pair of the plurality of first elastic sheets of the retaining member to their original state after the pair of the side joint bodies of another one of the joint connectors detach from the pair of side receiving cavities.

14. The method of claim 12, further comprising steps of:

deposing a main supporting pole into a central through hole of the base body;

receiving an upper supporting frame inside a main extension through hole of the extension member;

coupling one of the plurality of the joint connectors with a lower supporting frame;

wherein the base body comprises a plurality of retaining members axially arranged around the central through hole.

15. The method of claim 12, further comprising steps of: biasing against a front portion of another one of the plurality of the joint connectors by a blocker arranged within a retaining receiving cavity of the retaining member and between the pair of the plurality of the first elastic sheets to secure the another one of the plurality of the joint connectors within the retaining receiving cavity of the retaining member.

16. The method of claim 12, wherein the pair of side receiving cavities are symmetrically arranged on two sides of a retaining receiving cavity of the retaining member and one of the plurality of the first elastic sheets is arranged on one of the pair of the side receiving cavities, and another one of the plurality of the first elastic sheets is arranged on another one of the plurality of the side receiving cavities.

17. The method of claim 12, wherein another one of the plurality of the joint connectors comprises a hollow main joint body, a front portion integrally extended from the hollow main joint body, and the pair of side joint bodies symmetrically formed on two sides of the front portion, wherein a top portion of an upper supporting frame is coupled within the hollow main joint body and a middle portion of the upper supporting frame is received within the extension member.

18. The method of claim 12, wherein the extension member comprises a pair of side extension bodies configured to form a pair of side extension cavities and the pair of second elastic sheets formed within the pair of side extension cavities.

19. The method of claim 12, further comprising steps of: inserting a protruded locker of the one of the plurality of the joint connectors into an upper supporting frame and/or a lower supporting frame to secure the one of the plurality of the joint connectors with the upper supporting frame or/and the lower supporting frame; wherein the protruded locker is protruded from an outer surface of a hollow main joint body of the one of the plurality of the joint connectors.

* * * * *